US009888791B2

(12) United States Patent
Guitton

(10) Patent No.: US 9,888,791 B2
(45) Date of Patent: Feb. 13, 2018

(54) PLATFORM AND DOUBLE FRAME DISPLAY HANGING SYSTEM

(71) Applicant: Maurice Guitton, Nova Scotia (CA)

(72) Inventor: Maurice Guitton, Nova Scotia (CA)

( * ) Notice: Subject to any disclaimer, the term of this patent is extended or adjusted under 35 U.S.C. 154(b) by 0 days.

(21) Appl. No.: 15/019,510

(22) Filed: Feb. 9, 2016

(65) Prior Publication Data

US 2017/0224136 A1 Aug. 10, 2017

(51) Int. Cl.
*A47G 1/06* (2006.01)

(52) U.S. Cl.
CPC ..... *A47G 1/065* (2013.01)

(58) Field of Classification Search
CPC ..... A47G 1/065; A47G 1/06
See application file for complete search history.

(56) References Cited

U.S. PATENT DOCUMENTS 520,385 A * 5/1894 Allen ..... A47G 1/06 40/798
3,408,759 A * 11/1968 Rotheraine ..... A47G 1/06 271/276
3,916,549 A * 11/1975 Storch ..... A47G 1/06 40/746
4,510,707 A * 4/1985 Girard ..... A47G 1/065 40/27.5
4,939,858 A * 7/1990 Dailey ..... A47G 1/06 40/732
5,915,857 A * 6/1999 Gallagher ..... A47G 1/06 40/768
6,928,762 B1 * 8/2005 Fattahi ..... A47G 1/06 40/741
8,959,817 B1 * 2/2015 Barnes ..... G09F 7/04 40/711

* cited by examiner

*Primary Examiner* — Gary C Hoge
(74) *Attorney, Agent, or Firm* — Dean Craine

(57) ABSTRACT

A molded double frame display hanging frame system that is easy to assemble to hang a display object on a vertical surface. The system includes a square or rectangular platform with four, straight perpendicularly aligned outer edges. Attached to the platform's outer edges is the outer frame. Formed on the center region of the platform is a four sided, raised inner frame structure that allows an inner frame to be selectively attached to the front surface of the platform. A plurality of holes are formed at the inside corners of the mounting area adjacent to the inner frame structure which receive pin connectors that hold the display object over the mounting area. A transparent panel may be placed over the display object and held in position by the inner frame. The platform, the outer frame, and the inner frame may be made of molded composite material.

16 Claims, 8 Drawing Sheets

PLATFORM AND DOUBLE FRAME DISPLAY HANGING SYSTEM

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to wall displays or hangings, and more particularly to wall displays or hangings that include a rigid platform that may be selectively modified by the end user enabling it to be decorative outer and inner frames and a sheet of matting.

2. Description of the Related Art

Wall displays or hangings used to display objects, such as pictures, photos, portraits, 3D printed canvas, are mounted on a rigid planar structure. Sometimes, the planar structure is surrounded by a square or rectangular outer frame. The display object is placed over the front surface of the planar structure and inside the outer frame. Sometimes a decorative sheet of matting is placed inside the outer frame that includes center opening that surrounds the display object. When used with a sheet of matting, the display object is recessed inside the center opening form in the sheet of matting. A large sheet of glass or transparent material is placed inside the outer frame that covers the sheet of matting and the display object.

To further enhance the appearance of the wall display or hanging, an inner frame may be mounted inside the outer frame that surrounds the display object. The inner frame is mounted centrally on the wall display or hanging and evenly spaced inward from the outer frame.

What is needed is an inexpensive lightweight platform for a wall display or hanging that can be selectively used with or without an outer or inner frame, and with or without a sheet of matting that can be easily attached or removed from platform. What is also needed is such a system that can be easily painted by the end user.

SUMMARY OF THE INVENTION

A platform and a double frame display hanging system is shown and described that is relatively inexpensive, and can be easily modified by the end user.

The wall hanging system includes a lightweight, square or rectangular platform with a hollow rear cavity and a large front surface upon which a display object is placed. The platform has four perimeter side edges and clips or wires mounted on the rear cavity that allow it to be hung vertically on a wall.

The platform may be sold as a kit with a decorative outer frame designed to attach to the platform's four perimeter side edges. Suitable threaded connectors attach the outer frame to the outer edges of the platform's side edges.

The platform includes a mounting area surrounded by a gutter or curb system. A display object is placed over the mounting area. The platform kit may include an inner frame configured to attach and to cover the gutter or curb. In one embodiment, the gutter is a continuous or intermittent slot formed on four sides of the mounting area. In another embodiment, a single continuous or intermittent wall structure parallel to the gutter is formed on the platform. In still another embodiment, a continuous or intermittent double wall structure is formed on the opposite sides of the gutter.

A plurality of holes are formed at the inside corners of the mounting area adjacent to the gutter or the inner wall structures which receives pin connectors to hold a planar display object over the mounting area. The pin connectors may include a post and a perpendicularly aligned outer cap that presses against and holds the corner of the display object against the front surface of the platform. The posts are sufficient in length to extend through the platform and connect to a locking back member on the inside surface of the outer platform.

The platform kit may include a smaller, compatible inner frame configured to selectively attach to an inner frame attachment structure formed on the front surface of the platform. In another embodiment, the platform may be sold with only the inner frame and without the outer frame.

The inner frame attachment structure is a gutter, a single wall or double wall formed on the front surface of the platform. The inner frame is configured to snap fit into the gutter or around the single or double wall structures allowing it to be easily attached and detached to the platform. The shape and size of the inner frame are configured to surround and fits centrally inside the outer frame. The inner frame may also include an inner edge that extends over and covers the outer cap used to hold the display object on the platform. The inside edge of the inner frame may be recessed to receive the perimeter edge of the transparent panel. A transparent panel may be placed over the photograph or painting and held in position by the inner frame.

The above mentions kits may also include different sizes, shapes, and colors of matting with or without a pre-formed center cutout that surrounds the display object. The sheet of matting maybe pre-cut to extend across the entire front surface of platform, or pre-cut to extend only across the front surface of the platform between the inner frame.

In the embodiment shown, the outer frame, outer platform, and inner frame are made of ABS plastic or manufactured by a CNC machine which allows them to be painted or bonding. The outer and inner frames may be raised, flat or recessed.

Optional wall hanging holes may be formed on the rear surface of the platform that receives suitable connectors used with a hanging wire.

DESCRIPTION OF THE PREFERRED EMBODIMENT(S)

There is shown a wall hanging system 10 easy to assembly for hanging a display object, such as a picture, photograph, a portrait, advertising, etc, (indicated by the reference number 110).

Figure 1:
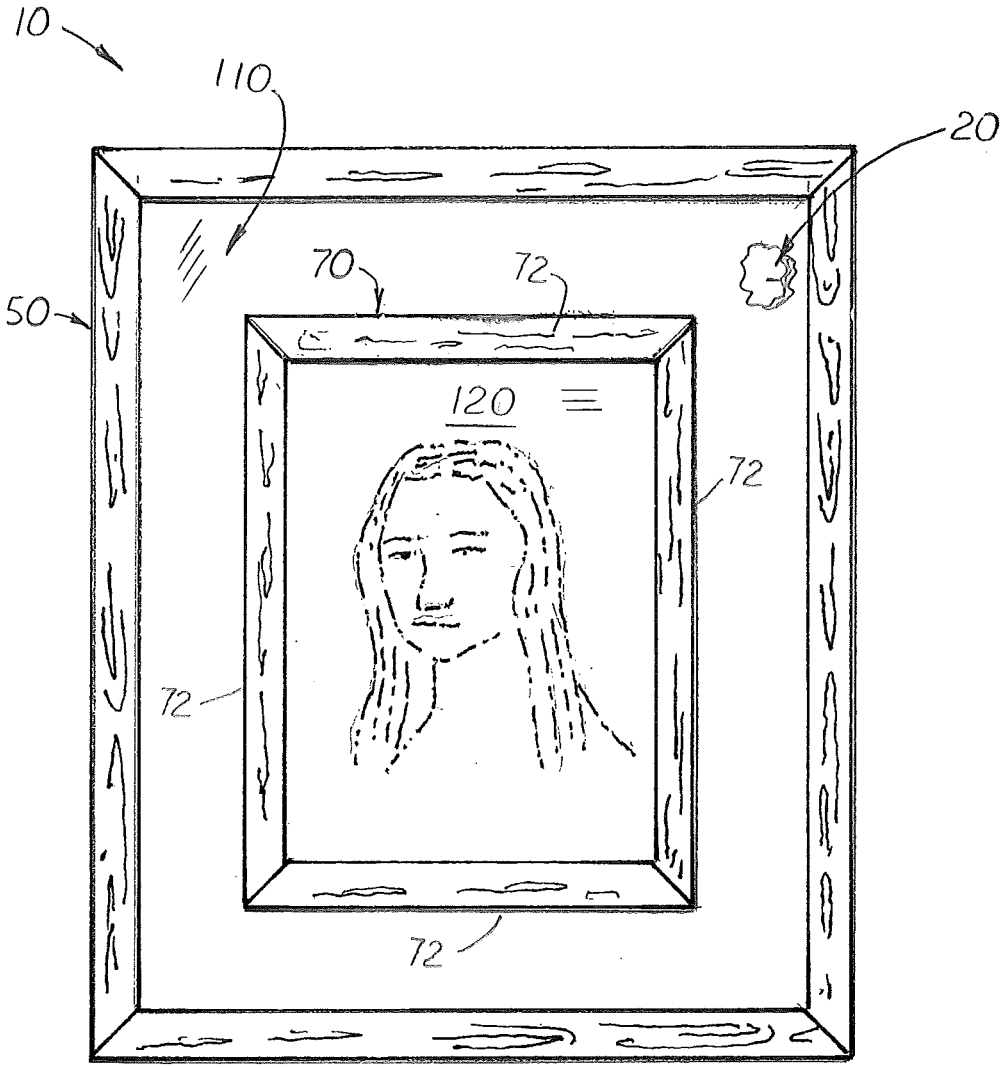
FIG. 1 is a front plan view of the molded picture frame.
Figure 2:
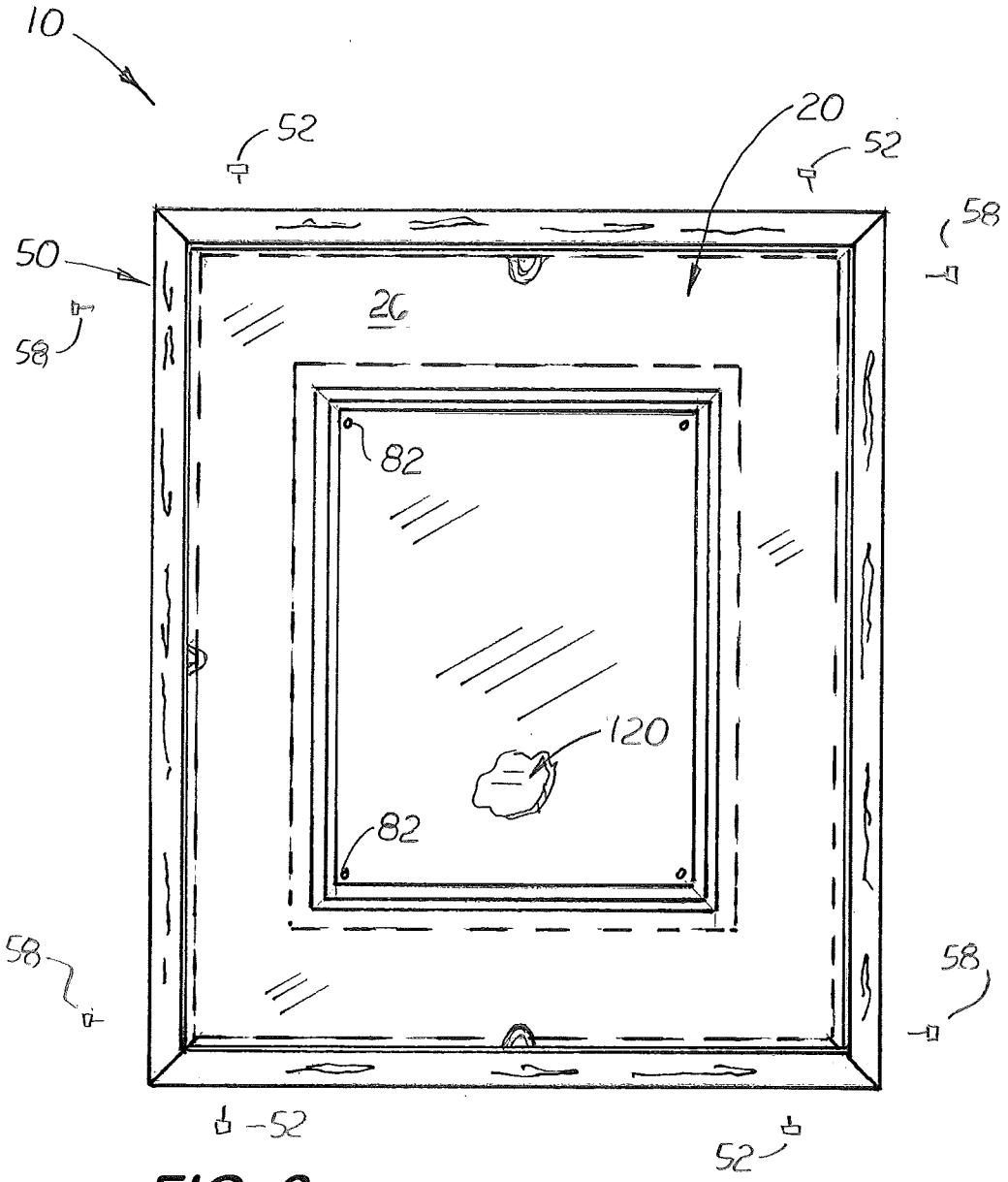
FIG. 2 is a rear plan view of the molded picture frame shown in FIG. 1.
Figure 3:
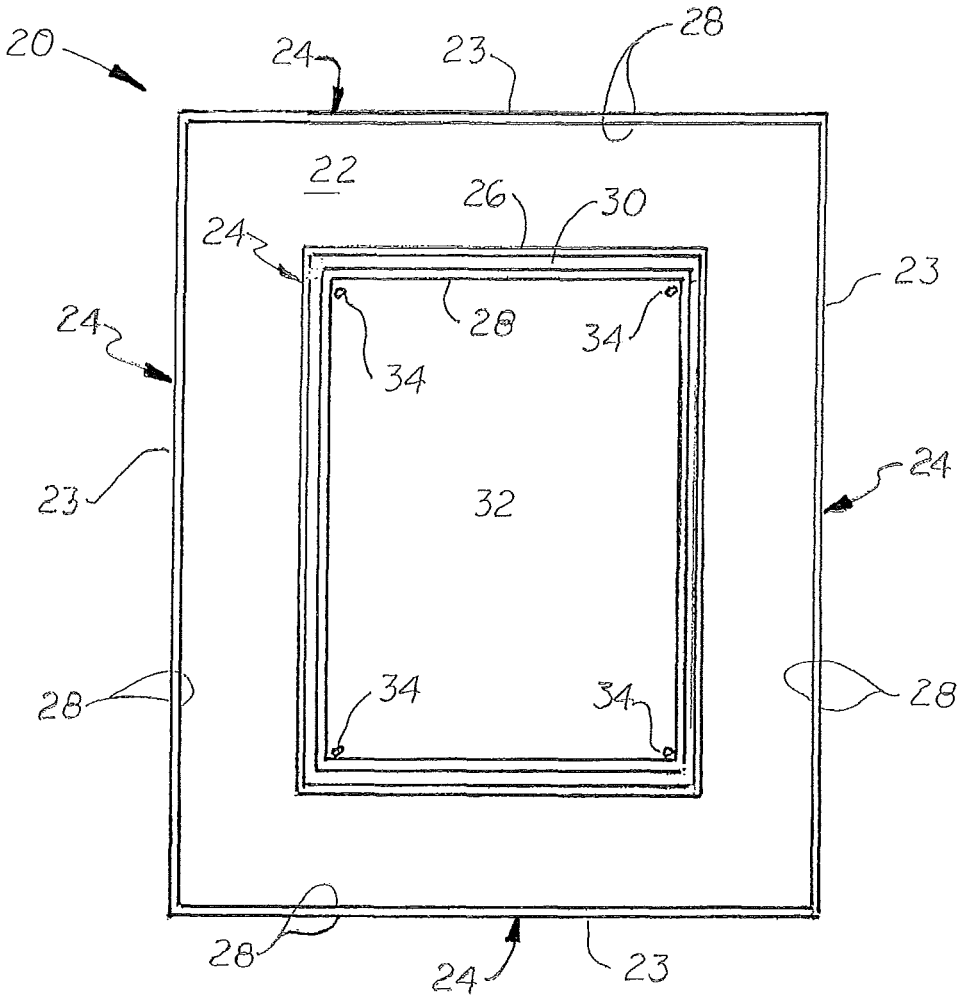
FIG. 3 is a front plan view of the platform used in the picture frame.

The wall hanging system 10 includes a large square or rectangular platform 20 with four, straight perpendicularly aligned outer edges 23 (see FIG. 3). Attached to the platform's four outer edges 23 is an optional decorative outer frame 50 (see FIGS. 1 and 2). Suitable threaded connectors 52 may be used to attach the outer frame 50 to the outer edges 23. Formed on the center region of the front surface 22 of the platform 20 is an inner frame attachment structure 60 discussed further below to which an inner frame 70 is selectively attached.

The platform 20 includes a front surface 22 and four perimeter edges 23. Formed on the front surface 22 is a central mounting area 32. The platform 20 includes four side walls 24 and a recessed rear cavity 26 behind the front surface 22. The platform 20 may include a continuous or intermitted outer raised, forward extending perimeter lip 28 adjacent to the four perimeter edges 23 Formed and extending through the platform 20 is a plurality of holes 34. The holes 34 are near the inside corners of the mounting area 32 adjacent to the inner frame attachment structure 60 discussed further below. When attaching a display object 110 to the mounting area 32, pin connectors 82 are extended into the holes 34 to hold a planar display object 110 over the mounting area 32.

Figure 4:
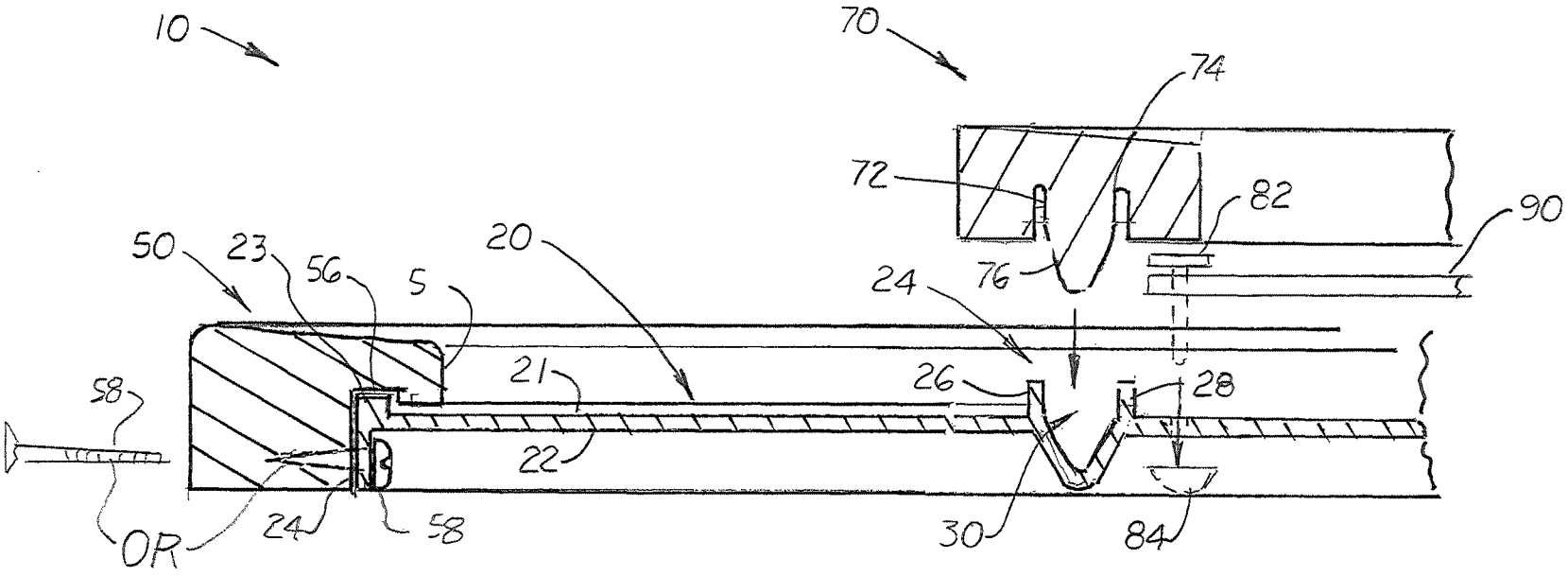
FIG. 4 is a partial, sectional side elevational view of the platform showing outer frame attached to the side edge of the platform and showing the inner frame being inserted into the inner curb.
Figure 5:
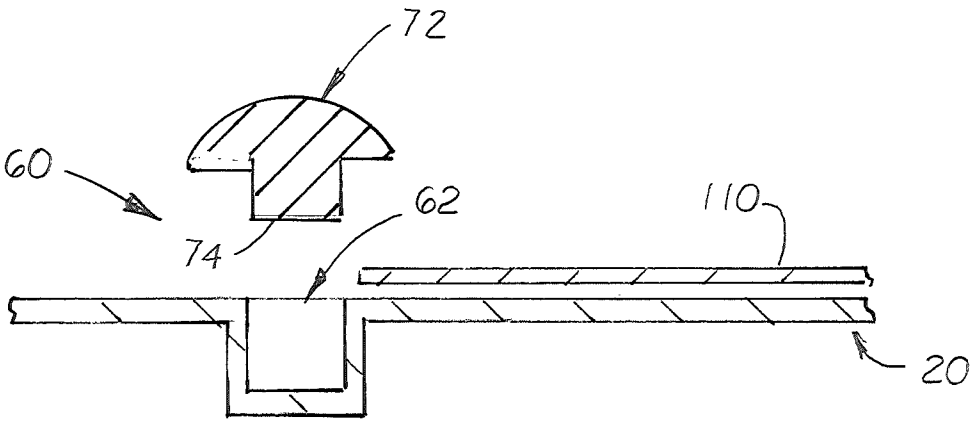
FIG. 5 is a sectional side elevational view showing the inner frame attachment structure as a gutter and showing an inner frame segment with an insert member that snap fits into the gutter.
Figure 6:
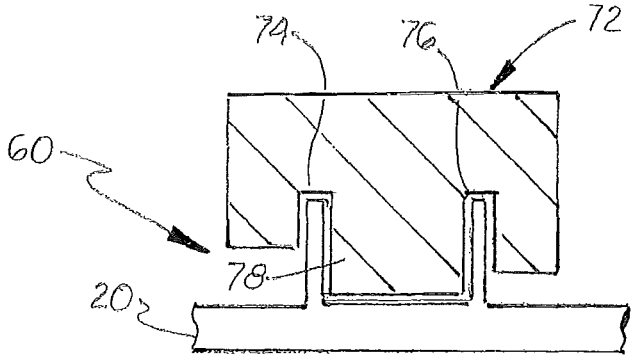
FIGS. 6-7 are sectional views showing the inner frame attachment structure including two parallel outward extending walls separated by a slot and showing three alternative inner frame segments that attaches to the three inner frame attachments structures.
Figure 7:
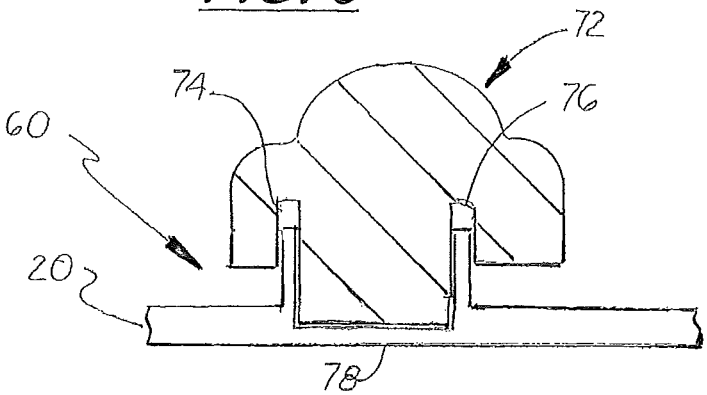

Attached to the outer perimeter edge of the platform 20 is an optional outer frame 50. In the embodiment in the FIG. 4, the outer frame 50 extends around the entire platform 20 and each outer frame segment 52 is sufficiently wide to partially extend over the front surface 22 adjacent to the perimeter edge 24. Each outer frame segment 52 on the outer frame 50 may also include a L-shaped bottom surface 54 that allow the outer frame segment 52 to partially extend over the side wall 24 of the platform 20. Suitable connectors 58 may attach the outer frame segment 52 to the side walls 24.

An inner frame attachment structure 60 is formed on the front surface 22 of the platform 20. The inner frame attachment structure 60 may be a continuous or intermittent gutter 62, a continuous or intermittent forward extending single wall 64 or two continuous or intermittent parallel double walls 64, 66 with or without a gutter 62 formed between them.

Attached to the inner frame attachment structure 60 is an optional inner frame 70. In the preferred embodiment, the inner frame 70 includes four inner frame segments 72 that form a square or rectangular inner frame 70 that fits inside the outer frame 50 and over the front surface 22 of the platform 20. The widths and lengths of the inner frame segments 72 are configured so the inner frame 70 is evenly spaced apart from the outer frame 50.

Figure 8:
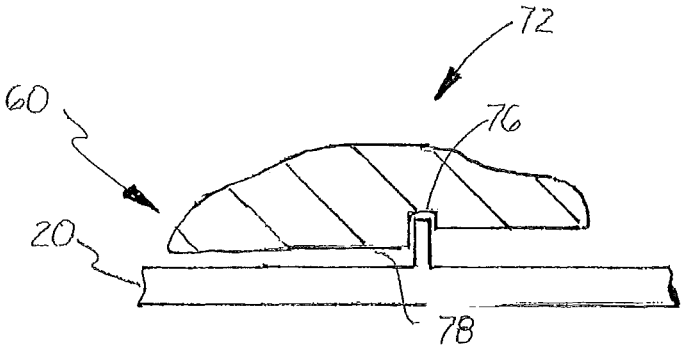
FIG. 8 is a sectional view showing the inner frame attachment structure including one wall attached to an alternative inner frame segments with a slot formed on its bottom surface.

The profile shape of the inner frame segment 72 depends on the inner frame attachment structure 60 formed on the platform 20. If the inner frame attachment structure 60 is a single gutter 62, as shown in FIG. 8, then the inner frame segment 72 includes a downward extending insert member 74 that snap fits into the gutter 62. If the inner frame attachment structure 60 includes one or two forward extending walls 64, 66 separated by a gutter 62, then the inner frame segment 72 includes two slots 74, 76 and a protruding lip 78 which snaps into the gutter 62.

Figure 9:
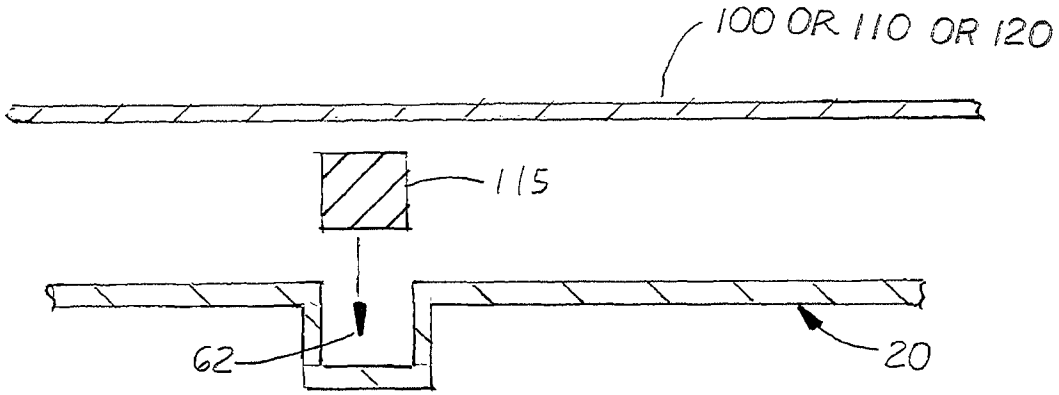
FIG. 9 is shows a platform with the inner frame attachment system being a single gutter formed on the platform with an optional space block inserted into the gutter to form a continuous front surface on the platform over which a sheet of matting, transparent panel or the display object may be placed.

FIG. 9 shows a platform 20 with the inner frame attachment structure 60 being a gutter 62 with a plug base 115 that fits into the gutter 62 to form a flat front surface on the platform 20 upon with a sheet of matting 100, a display object 110 or a transparent panel 120 may be attached.

A plurality of holes 34 are formed at the inside corners of the mounting area 32 adjacent to the inner curb 24 which receive pin connectors 82 to hold a planar photograph 90 over the mounting area 32. The pin connectors 82 include an outer cap 83 with a perpendicularly aligned post 84. The posts 84 are sufficient in length to extend through the platform 20 and connect to a locking back member 85 on the rear surface 22 of the platform 20.

A transparent panel 120 may be placed over the display object 110 and held in position by the inner frame 70.

Figure 10:
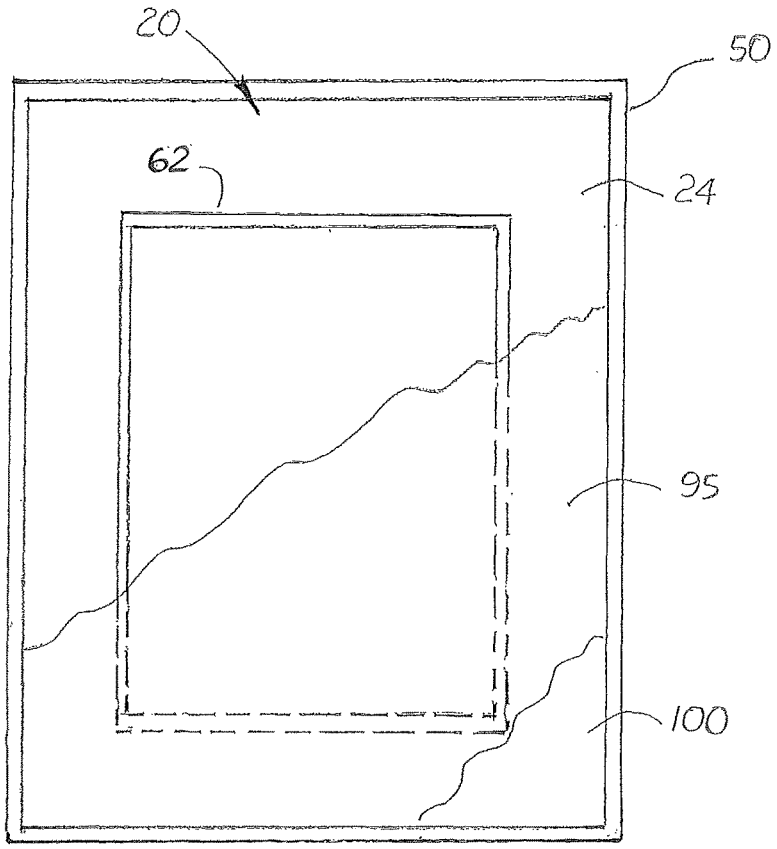
FIG. 10 is a front plan view of an alternative platform with an inner raised curb, an outer frame attached to the perimeter edge, an intermediated support panel with a square insert member attached to its bottom surface that attaches to the raised curb, and a sheet of matting, a transparent panel or the display.
Figure 11:
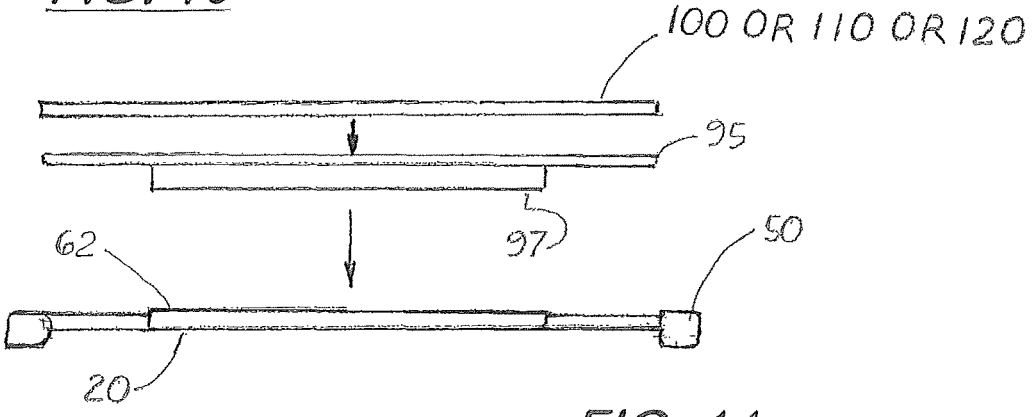
FIG. 11 is an exploded side elevational view of the planar insert member being attached to the platform shown in FIG. 5 with the planar intermediate member with a downward attached planar insert that fits into the center space formed inside the inner raised curb, with a display object mounted over the front surface of the planar intermediate member.

FIG. 10 is a front plan view of an alternative platform 20 with an inner raised curb 62, an outer frame 50 attached to the perimeter edge, an intermediated support panel 95 with a square insert member 97 attached to its bottom surface that attaches to the raised curb 62, and a matting 100, a transparent panel 110 or the display 120.

In the embodiment shown, the platform 20, the outer frame 50, and inner frame 70 may be made of ABS plastic that may be painted or bonding. The outer frame 50 and inner frame 78 may be raised, flat or recessed. Optional wall hanging cups or holes may be formed on the rear surface 22 of the platform 20 that receive suitable connectors used with a hanging wire.

The platform 20 may also be sold as a kit that includes not only the outer frame 50 but a smaller, compatible inner frame 70 configured to selectively attach to an inner frame attachment structure 60 formed on the front surface 22 of the platform 20. In another embodiment, the platform 20 may be sold with only the inner frame.

The above mentions kits may also include different sizes, shapes, and colors of matting 110 with or without a preformed center cutout for the display object 120. The matting maybe pre-cut to extend across the entire front surface of platform, or pre-cut to extend only across the front surface of the platform between the inner frame.

In compliance with the statute, the invention described has been described in language more or less specific on structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A double wall display hanging frame system, comprising a. a planar platform with four outer edges, a front surface and a rear surface, said front surface includes a centrally aligned mounting area;

b. an outer frame formed or attached to said outer edges of said platform;

c. a plurality of connectors used to attach said outer frame to said outer edges of said platform; and, d an inner frame attachment structure formed on said front surface of said platform, said inner frame attachment structure is a gutter that surrounds said mounting area on said front surface of said platform.

2. The system as recited in claim 1, further including an inner frame configured to attach to said inner frame attachment structure.

3. The system as recited in claim 1, further including a plurality of holes formed on said platform and inside said inner frame attachment structure.

4. The system as recited in claim 3, further including a plurality of connectors configured to extend through said holes to hold a display object over said front surface of said platform.

5. The system as recited in claim 1, further including an inner frame configured to attach to said gutter.

6. The system as recited in claim 1, wherein said an inner frame attachment structure is a gutter and at least one outward extending wall adjacent to said gutter and formed on said front surface of said platform.

7. The system as recited in claim 6, further including an inner frame configured to attach to said gutter and said wall.

8. The system as recited in claim 1, wherein said platform is a parallelogram with four perimeter edges.

9. The system as recited in claim 8, wherein said outer frame is separately attached to said perimeter edges of said platform.

10. A wall hanging platform, comprising:

a. a planar platform with four perimeter edges, a front surface and a recessed rear cavity opposite the front surface, said front surface includes a centrally aligned mounting area;

b. an inner frame attachment structure formed on said front surface of said platform, said inner frame attachment structure surrounds said mounting area on said front surface of said platform;

c. a plurality holes formed on said planar platform, said holes located inward from said inner frame; and, d. a plurality of pin connectors, each pin connector includes a head, a shank and a detachable end connector.

11. The platform as recited in claim 10, wherein said an inner frame attachment structure is a gutter formed on said front surface of said platform.

12. The platform as recited in claim 10, wherein said an inner frame attachment structure is a gutter and at least one outward extending wall adjacent to said gutter and formed on said front surface of said platform.

13. The platform as recited in claim 10, wherein said platform is a parallelogram with four perimeter edges.

14. A display or wall hanging platform kit, comprising:

a. a planar platform with four perimeter edges, a front surface with a mounting area, and a recessed rear cavity opposite the front surface, an inner frame attachment structure formed on said front surface of said platform, said inner frame attachment structure surrounds said mounting area on said front surface of said platform;

b. an outer frame that selectively attaches to said perimeter edges of said platform; and, c. an inner frame that selectively attaches to said inner frame attachment structure formed on said front surface;

d. a plurality holes formed on said platform inside said inner frame attachment structure; and, e. a plurality of pin connectors, each pin connector includes a head, a shank and a detachable end connector.

15. The display or wall hanging platform kit, as recited in claim 14, further including a sheet of matting configured to fit inside said outer frame or said inner frame.

16. The display or wall hanging platform kit, as recited in claim 14, further including a sheet of transparent material that fits inside said inner frame when attached to said platform.

* * * * *